US011185969B2

(12) United States Patent
Hsieh et al.

(10) Patent No.: US 11,185,969 B2
(45) Date of Patent: Nov. 30, 2021

(54) PNEUMATIC TOOL HAVING MOVABLE AIR TUBE

(71) Applicants: Chih-Kuan Hsieh, Hemei Township, Changhua County (TW); Ya-Chun Lai, Taoyuan (TW)

(72) Inventors: Chih-Kuan Hsieh, Hemei Township, Changhua County (TW); Ya-Chun Lai, Taoyuan (TW)

( * ) Notice: Subject to any disclaimer, the term of this patent is extended or adjusted under 35 U.S.C. 154(b) by 93 days.

(21) Appl. No.: 16/595,558

(22) Filed: Oct. 8, 2019

(65) Prior Publication Data

US 2021/0101271 A1 Apr. 8, 2021

(51) Int. Cl.

| | |
|---|---|
| ***B25D 9/08*** | (2006.01) |
| ***B25D 9/04*** | (2006.01) |
| ***B25D 17/24*** | (2006.01) |
| ***B25D 17/04*** | (2006.01) |

(52) U.S. Cl.

CPC ..... *B25D 9/08* (2013.01); *B25D 9/04* (2013.01); *B25D 17/046* (2013.01); *B25D 17/24* (2013.01); *B25D 2250/181* (2013.01)

(58) Field of Classification Search

CPC ..... B25D 9/08; B25D 9/04; B25D 17/046; B25D 17/24; B25D 2250/181

USPC ..... 173/200, 169, 206

See application file for complete search history.

(56) References Cited

U.S. PATENT DOCUMENTS

| | | | | |
|---|---|---|---|---|
| 3,791,461 A * | 2/1974 | Rosselet | B25D 9/22 173/48 |
| 6,192,997 B1 * | 2/2001 | Tsai | B25D 9/18 173/162.1 |
| 9,844,867 B2 * | 12/2017 | Hsieh | B25D 9/08 |
| 2011/0232929 A1 * | 9/2011 | Chang | B25D 17/24 173/162.2 |

* cited by examiner

*Primary Examiner* — Anna K Kinsaul
*Assistant Examiner* — Luis G Del Valle
(74) *Attorney, Agent, or Firm* — Alan D. Kamrath; Karin L. Williams; Mayer & Williams PC

(57) ABSTRACT

A pneumatic tool contains: a body, a drive unit, a piston element, at least one buffer, and a movable air tube. The body includes an intake head, a limiting sleeve, a switch, an air conduit, and a connection portion. The connection portion has a first guide element, a first guiding orifice, and the limiting sleeve has a shoulder. The drive unit includes a moving tube, a first segment, and a second segment. The moving tube has a protrusion, the second segment has a second guide element and a second guiding orifice. The moving tube has a coupling orifice and a cavity, and an air valve is defined between the cavity and the second guide element. One buffer is defined between the first guide element and the second guide element and includes a first through hole. The movable air tube includes an air inlet segment and an air outlet segment.

9 Claims, 10 Drawing Sheets

PNEUMATIC TOOL HAVING MOVABLE AIR TUBE

BACKGROUND OF THE INVENTION

Field of the Invention

The present invention relates to a pneumatic tool, and more particularly to the pneumatic tool having a movable air tube.

Description of the Prior Art

A conventional pneumatic tool is driven by a power source from compressed air of an air compressor so that the compressed air pushes a piston element to strike a tool head forwards and backwards, hence the piston element provides energy to the tool head as striking the tool head, and the conventional pneumatic tool cuts, punches, descales, removes rust, and chisels a workpiece.

Referring to FIGS. 7-10, a conventional pneumatic tool contains an intake head 91, a drive unit 92, a piston element 93, a spring 94, a tool head 95, and a shockproof sleeve 96.

The intake head 91 includes a switch 911 arranged on an outer wall thereof, a connection portion 912 fixed on an end of the intake head 91, and an air valve 913 accommodated in the connection portion 912. The drive unit 92 includes a fixed tube 921 which has a first segment 921A and a second segment 921B, wherein the second segment 921B is connected with the connection portion 912 of the intake head 91, the first segment 921A has a coupling orifice 9211 defined on a center thereof, a fixing trench 9212 formed adjacent to the first segment 921A, a cutout 9213 defined on the fixing trench 9212 and communicating with the coupling orifice 9211, two defining blocks 9214 accommodated in the cutout 9213, a restraining loop 9215 connected with the fixing trench 9212 so as to limit the two defining blocks 9214, a cylinder 9216 received in the fixed tube 921, a cavity 9217 formed in the cylinder 9216 and communicating with the coupling orifice 9211. The piston element 93 is slidably accommodated in the cavity 9217, and the spring 94 is received in the cavity 9217 and is defined between the piston element 93 and the air valve 913. The tool head 95 is a chisel inserted into the coupling orifice 9211 of the fixed tube 921 so that the two defining blocks 9214 mate with the restraining loop 9215 to limit the tool head 95. The shockproof sleeve 96 is fitted on an outer wall of the fixed tube 921 of the drive unit 92, and a gap A1 is defined between the shockproof sleeve 96 and the fixed tube 921 so as to receive two flexible elements 961, 962.

In use, the switch 911 is turned on so that high-pressure air flows into the first segment 921A of the fixed tube 921 from the intake head 91 via the air valve 913, such that the piston element 93 is pushed by the high-pressure air to strike the tool head 94, then the high-pressure air pushes the piston element 93 to move toward the air valve 913 so as to press the spring 94 to strike the air valve 913, thus pushing the piston element 93 forwards and backwards strikes the tool head 94 to chisel the workpiece.

Thus the spring 94 moves backward in the piston element 93 to strike the air valve 913 so as to reduce vibration and reaction force to a user's hand. The spring 94 is stroked directly by the piston element 93 to compress, but it cannot be protected and is damaged easily, thus replacing the spring 94 frequently and having using inconvenience and high using cost.

The present invention has arisen to mitigate and/or obviate the afore-described disadvantages.

SUMMARY OF THE INVENTION

The primary objective of the present invention is to provide a pneumatic tool having a movable air tube which when a piston element moves backward to strike an air valve, at least one buffer provide a buffering effect, and a movement travel of the movable air tube interfaces the buffering effect, such that a vibration of the pneumatic tool reduces effectively.

Another objective of the present invention is to provide a pneumatic tool having a movable air tube which a compression of the at least one buffer is limited by a movement travel of the movable air tube, thus protecting the at least one buffer, prolonging a service life of the at least one buffer, enhancing using convenience of the pneumatic tool, and reducing using cost.

To obtain above-mentioned aspects, a pneumatic tool having a movable air tube provided by the present invention contains: a body, a drive unit, a piston element, at least one buffer, and a movable air tube.

The body includes an intake head and a limiting sleeve, the intake head has a switch arranged on an outer wall of the intake head, an air conduit defined in the intake head, and a connection portion formed on an end of the intake head. The connection portion has a first guide element connected on an edge thereof, and the first guide element has a first guiding orifice, a first end of the limiting sleeve is connected with the connection portion of the intake head, and the limiting sleeve has a shoulder formed therein.

The drive unit includes a moving tube which has a first segment and a second segment, and the moving tube being slidably received in the limiting sleeve of the body. The moving tube has a protrusion formed on an outer wall thereof and stopped by the shoulder of the limiting sleeve so that the moving tube does not slide forward in the limiting sleeve, the second segment of the moving tube has a second guide element arranged therein, the second guide element has a second guiding orifice defined thereon, the moving tube has a coupling orifice defined on a center of the first segment thereof. The moving tube has a cavity communicating with the coupling orifice, and an air valve is defined between the cavity and the second guide element.

The piston element is slidably accommodated in the cavity of the drive unit.

The at least one buffer is flexible and is received in the limiting sleeve, one of the at least one buffer is defined between the first guide element and the second guide element, and the one buffer includes a first through hole defined on a center thereof.

The movable air tube is located on an axis with the air conduit and the piston element, the movable air tube is inserted into the first through hole of the one buffer and a second through hole of another buffer, and the movable air tube includes an air inlet segment and an air outlet segment. The air inlet segment is slidably inserted into the first guiding orifice of the first guide element, the air outlet segment is slidably inserted into the second guiding orifice of the second guide element so that the movable air tube slides along the axis forwards and backwards in a non-hand control manner, an outer wall of the air outlet segment of the movable air tube has at least one O-ring engaged thereon so that the at least one O-ring abuts against an inner wall of the second guiding orifice. When the air outlet segment of the movable air tube contacts with the air valve, a first distance is defined among the at least one O-ring and the second guiding orifice adjacent to the intake head, and a second distance is defined between the air inlet segment and the first guiding orifice adjacent to the intake head, wherein the first distance is more than the second distance.

DETAILED DESCRIPTION OF THE PREFERRED EMBODIMENTS

Figure 1:
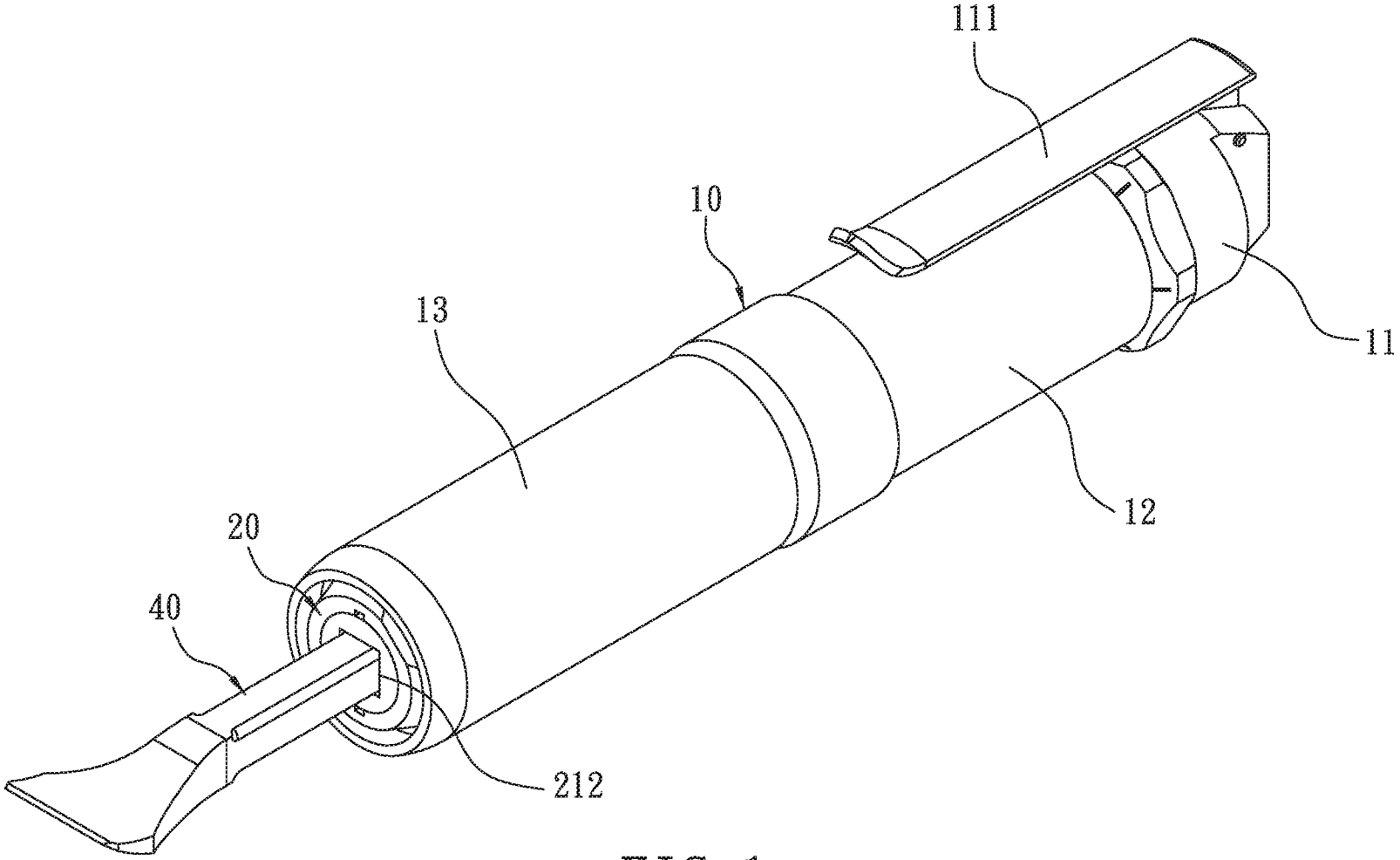
FIG. 1 is a perspective view showing the assembly of a pneumatic tool having a movable air tube according to a preferred embodiment of the present invention.
Figure 2:
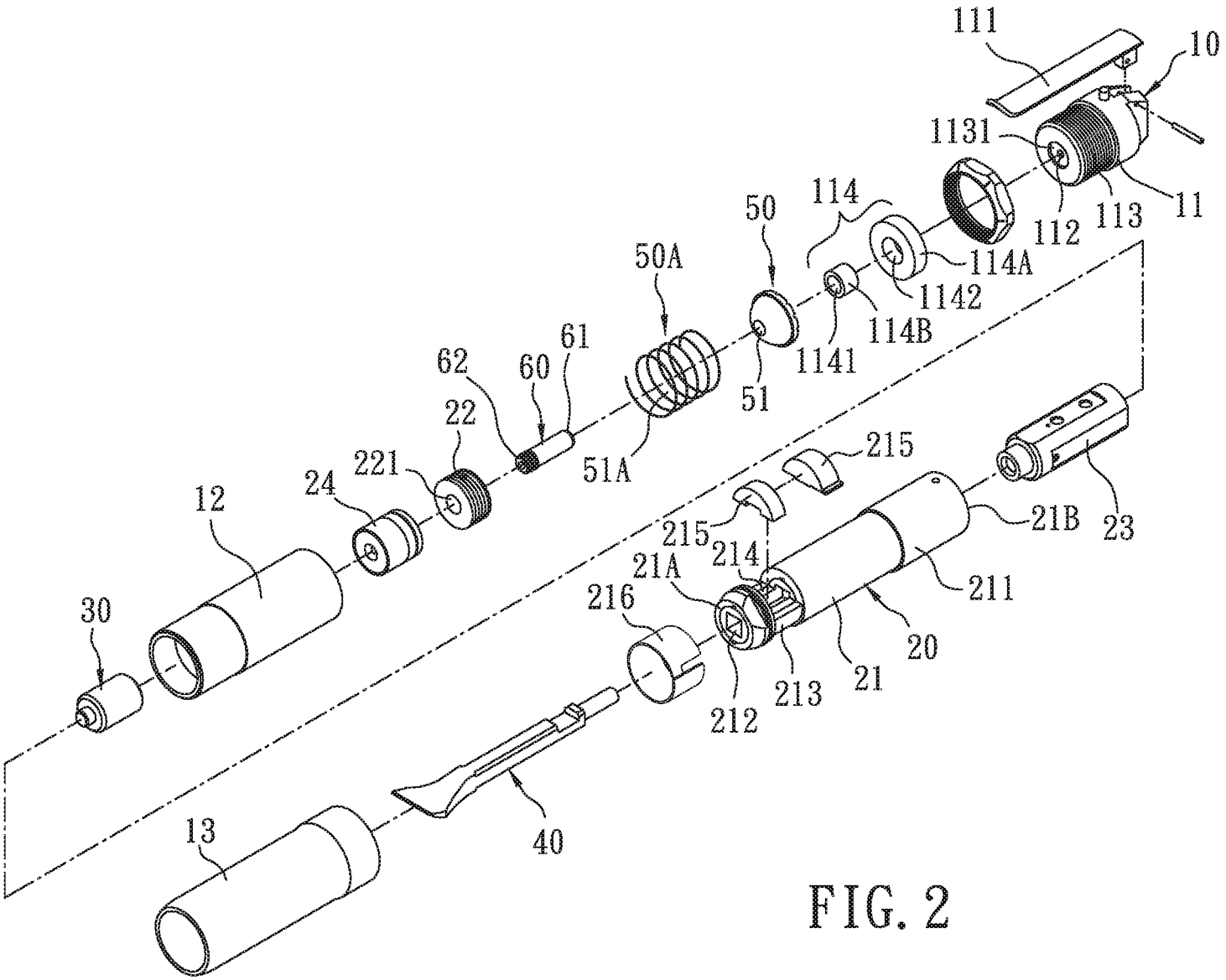
FIG. 2 is a perspective view showing the exploded components of the pneumatic tool having the movable air tube according to the preferred embodiment of the present invention.
Figure 3:
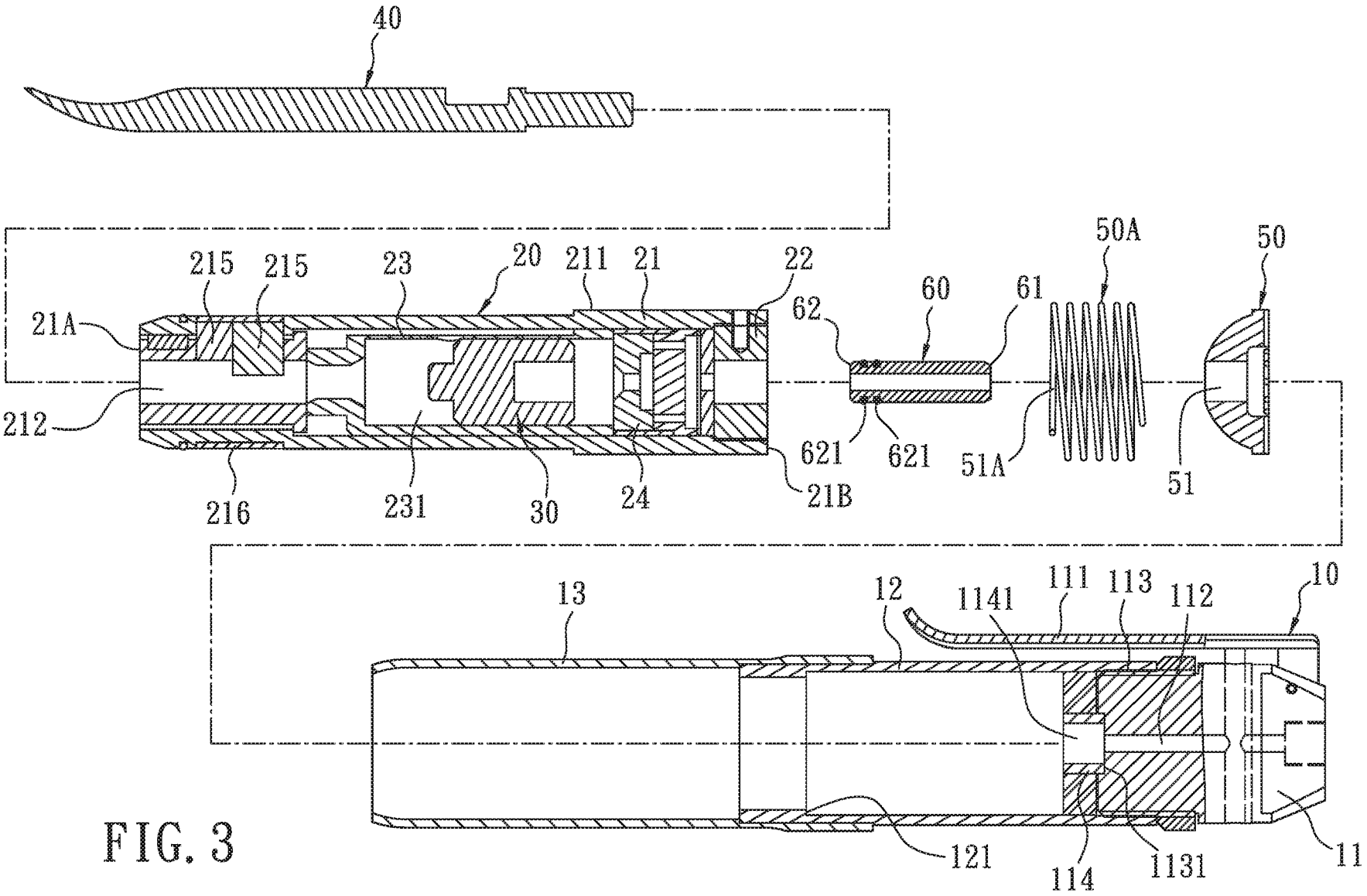
FIG. 3 is a cross sectional view showing the exploded components of the pneumatic tool having the movable air tube according to the preferred embodiment of the present invention.
Figure 4:
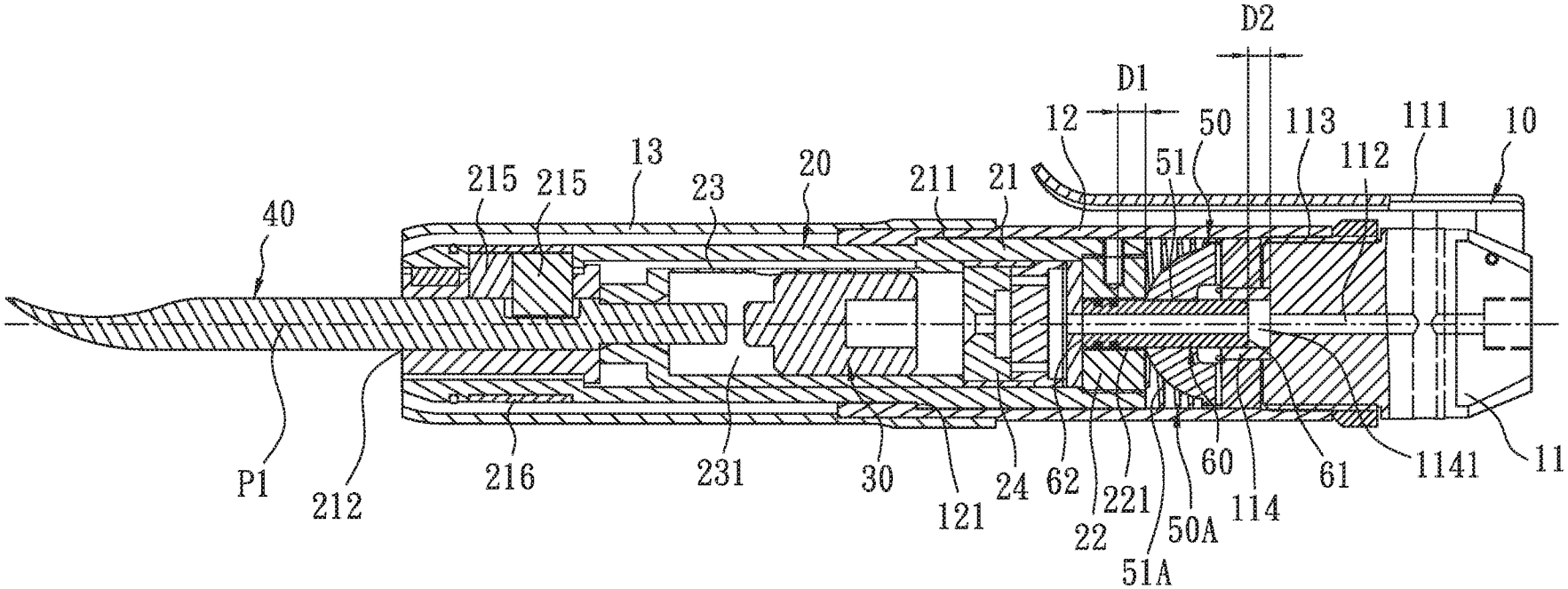
FIG. 4 is a cross sectional view showing the assembly of the pneumatic tool having the movable air tube according to the preferred embodiment of the present invention.

The present invention will be clearer from the following description when viewed together with the accompanying drawings, which show, for purpose of illustrations only, a preferred embodiment in accordance with the present invention.

With reference to FIGS. 1-4, a pneumatic tool having a movable air tube according to a preferred embodiment of the present invention comprises: a body 10, a drive unit 20, a piston element 30, a tool head 40, at least one buffer 50, and the movable air tube 60.

The body 10 includes an intake head 11, a limiting sleeve 12, and a shockproof sleeve 13. The intake head 11 has a switch 111 arranged on an outer wall thereof, an air conduit 112 communicating in the intake head 11, and a connection portion 113 formed on an end of the intake head 11, wherein the connection portion 113 has a groove 1131 defined on an edge thereof and has a first guide element 114 connected on the edge of the connection portion 113, and the first guide element 114 has a first guiding orifice 1141. A first end of the limiting sleeve 12 is connected with the connection portion 113 of the intake head 11, the limiting sleeve 12 includes a shoulder 121 formed therein, and the shockproof sleeve 13 is coupled with an end of the limiting sleeve 12 away from the intake head 11. The first guide element 114 has a positioning ring 114A and a bushing 114B, wherein the positioning ring 114A has a fitting orifice 1142 defined on a center thereof, the bushing 114B is fitted with the fitting orifice 1142, and an end of the bushing 114B is inserted into the groove 1131 of the connection portion 113, wherein the bushing 114B has the first guiding orifice 1141 defined thereon.

The drive unit 20 includes a moving tube 21 which has a first segment 21A and a second segment 21B, and the moving tube 21 is slidably received in the limiting sleeve 12 and the shockproof sleeve 13. The moving tube 21 has a protrusion 211 formed on an outer wall thereof and stopped by the shoulder 121 of the limiting sleeve 12 so that the moving tube 21 does not slide forward in the limiting sleeve 12. The moving tube 21 has a coupling orifice 212 defined on a center of the first segment 21A thereof, a fixing trench 213 formed adjacent to the first segment 21A of the moving tube 21, wherein the fixing trench 213 has a cutout 214 communicating with the coupling orifice 212 and accommodating two defining blocks 215, and the fixing trench 213 is connected with a restraining loop 216 so as to fix the two defining blocks 215. The second segment 21B of the moving tube 21 has a second guide element 22 arranged therein, the second guide element 22 has a second guiding orifice 221 defined thereon, wherein the moving tube 21 accommodates a cylinder 23, and the cylinder 23 has a cavity 231 communicating with the coupling orifice 212, wherein an air valve 24 is defined between the cavity 231 and the second guide element 22.

The piston element 30 is slidably accommodated in the cavity 231 of the drive unit 20.

The tool head 40 is inserted into the coupling orifice 212 of the moving tube 21, the two defining blocks 215 are connected with the cutout 214, and the restraining loop 216 is fixed in the fixing trench 213 so that the tool head 20 is limited in the first segment 21A of the moving tube 21.

One of the at least one buffer 50 is flexible hemispherical and is received in the limiting sleeve 12, wherein the one buffer 50 is defined between the first guide element 114 and the second guide element 22, and the one buffer 50 includes a first through hole 51 defined on a center thereof. Another buffer 50A is a spring and is fixed in the limiting sleeve 12, and another buffer 50A is defined between the first guide element 114 and the second guide element 22. In addition, the other buffer 50 has a second through hole 51A formed on a center thereof.

The movable air tube 60, the air conduit 112, and the piston element 30 are located on an axis P1, wherein the movable air tube 60 is inserted into the first through hole 51 of the one buffer 50 and the second through hole 51A of another buffer 50A. The movable air tube 60 includes an air inlet segment 61 and an air outlet segment 62, wherein the air inlet segment 61 is slidably inserted into the first guiding orifice 1141 of the first guide element 114, the air outlet segment 62 is slidably inserted into the second guiding orifice 221 of the second guide element 22 so that the movable air tube 60 slides along the axis P1 forwards and backwards in a non-hand control manner. An outer wall of the air outlet segment 62 of the movable air tube 60 has at least one O-ring 621 engaged thereon (in this embodiment, two O-rings 621 are engaged on the outer wall of the air outlet segment 62 of the movable air tube 60) so that the two O-rings 621 abut against an inner wall of the second guiding orifice 221. When the air outlet segment 62 of the movable air tube 60 contacts with the air valve 24, a first distance D1 is defined among the two O-rings 621 and the second guiding orifice 221 adjacent to the intake head 11, and a second distance D2 is defined between the air inlet segment 61 and the first guiding orifice 1141 adjacent to the intake head 11, wherein the first distance D1 is more than the second distance D2.

Figure 5:
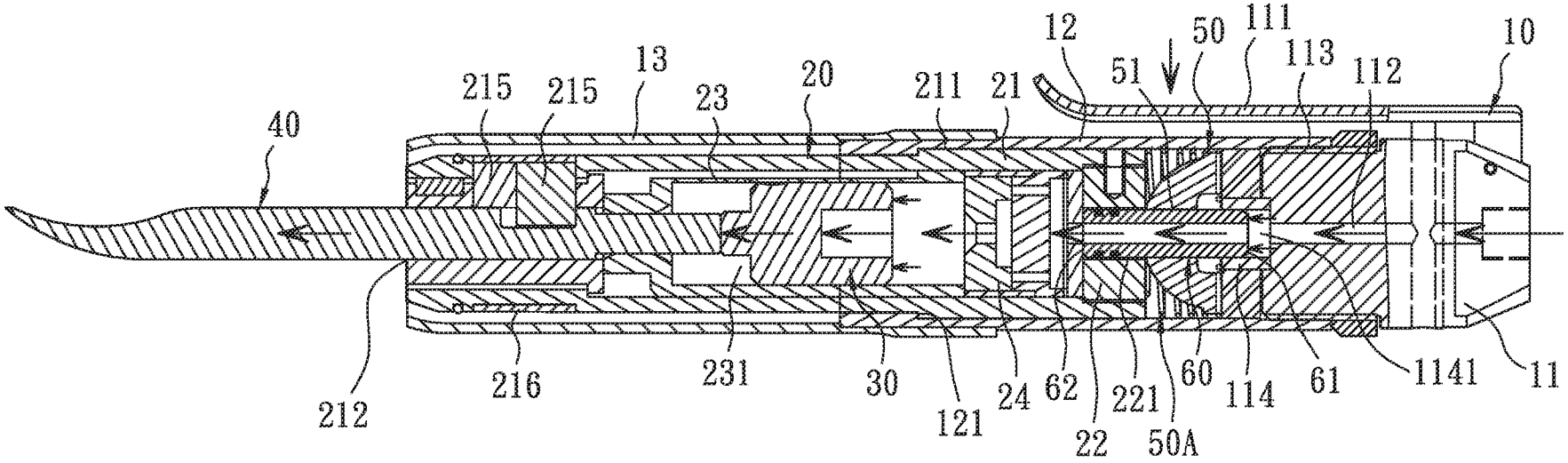
FIG. 5 is a cross sectional view showing the operation of the pneumatic tool having the movable air tube according to the preferred embodiment of the present invention.
Figure 6:
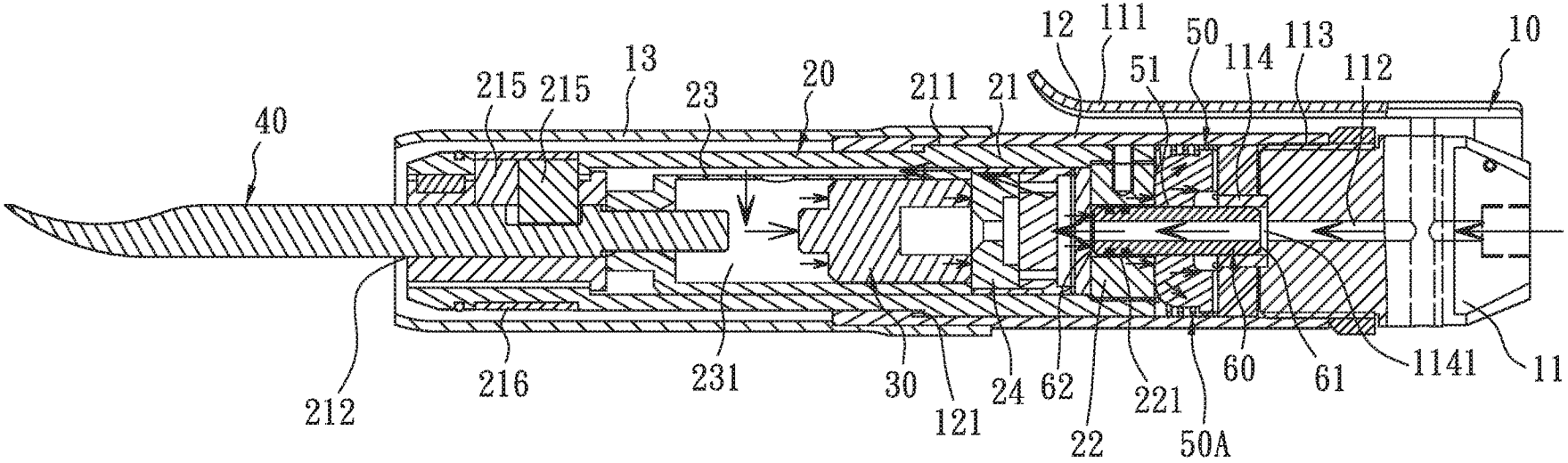
FIG. 6 is another cross sectional view showing the operation of the pneumatic tool having the movable air tube according to the preferred embodiment of the present invention.
Figure 7:
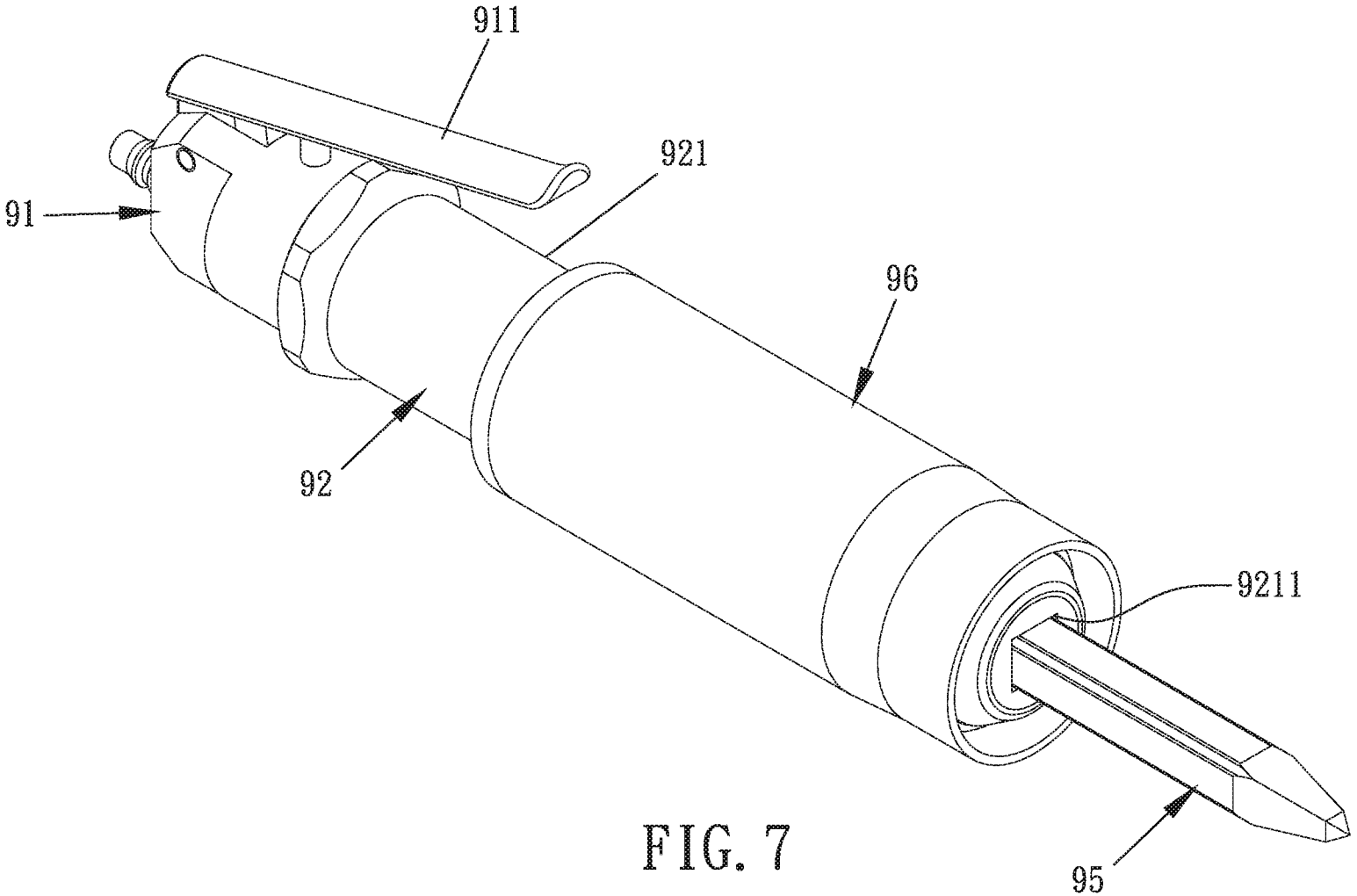
FIG. 7 PRIOR ART
FIG. 7 is a perspective view showing the assembly of a conventional pneumatic tool.
Figure 8:
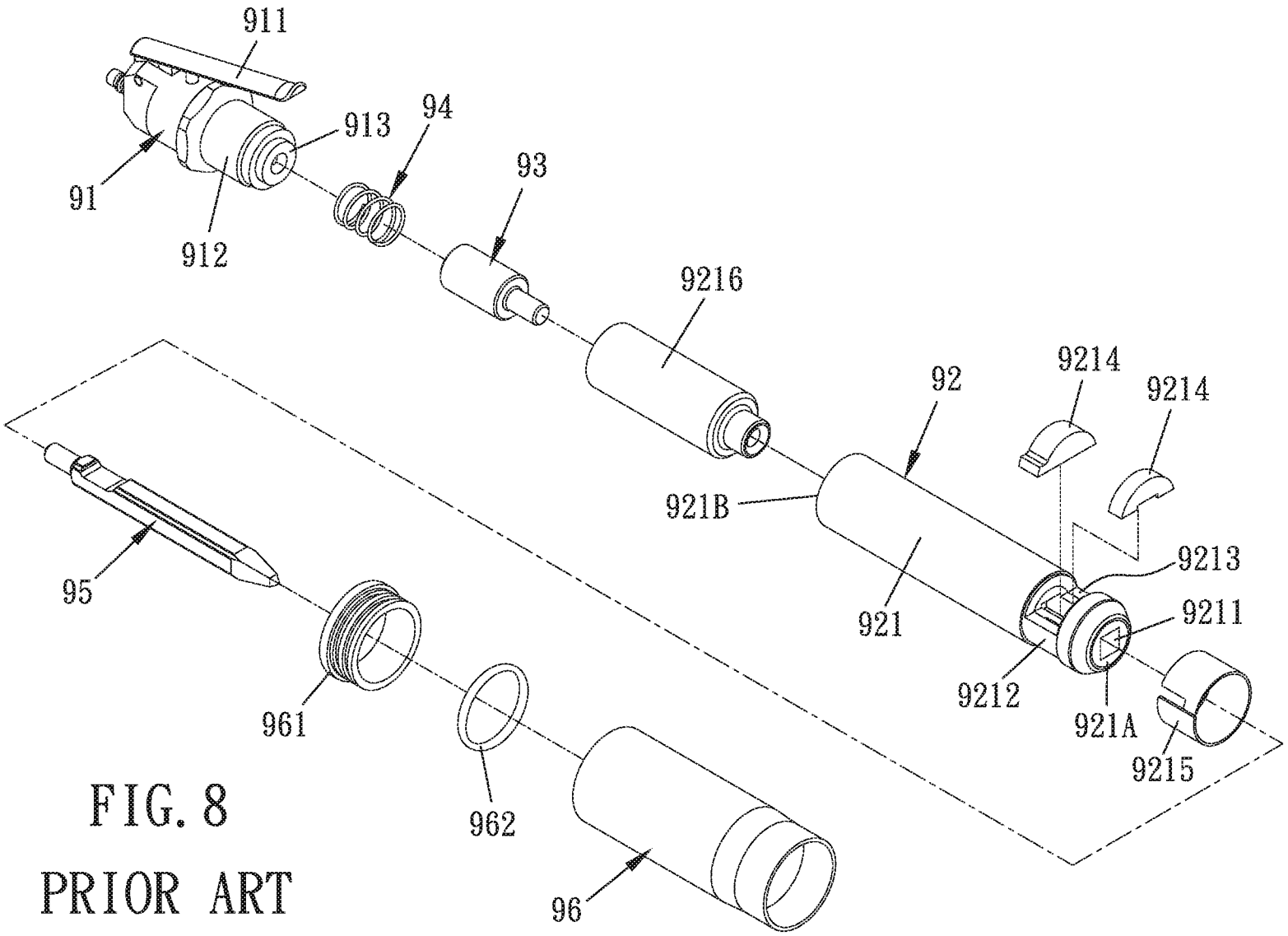
FIG. 8 PRIOR ART
FIG. 8 is a perspective view showing the exploded components of the conventional pneumatic tool.
Figure 9:
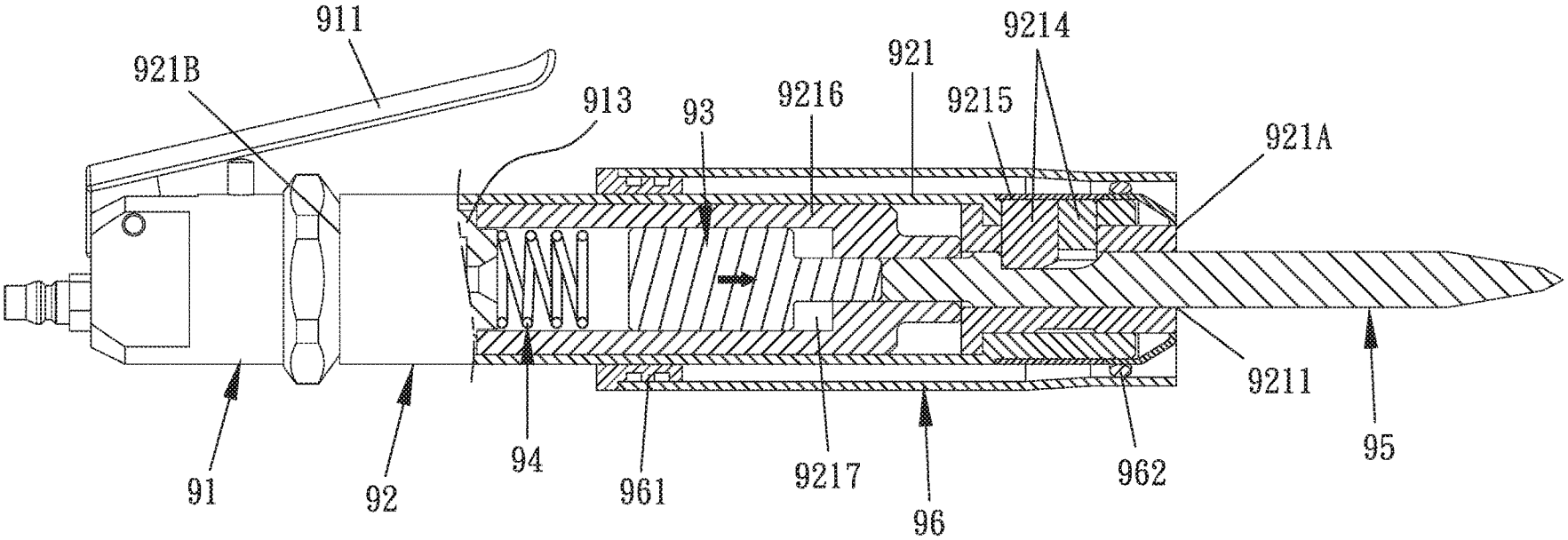
FIG. 9 PRIOR ART
FIG. 9 is a cross sectional view showing the operations of the conventional pneumatic tool.
Figure 10:
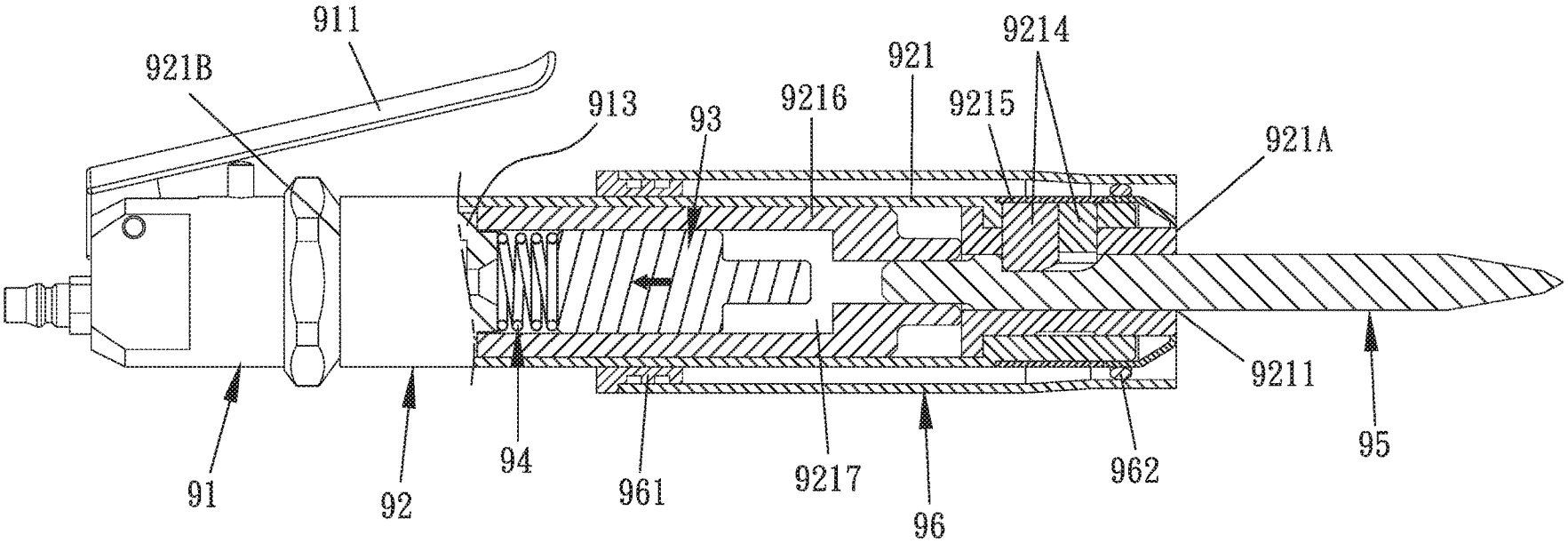
FIG. 10 PRIOR ART
FIG. 10 is another cross sectional view showing the operations of the conventional pneumatic tool.

In use, as shown in FIG. 5, the switch 111 of the body 10 is started so that high-pressure air flows into the air valve 24 from the air conduit 112 of the intake head 11 via the movable air tube 60 to be controlled by the air valve 24 and to enter into the cavity 231, and the high-pressure air flows to the first segment 21A of the moving tube 21 so as to push the piston element 30 to movably hit the tool head 40. Referring further to FIG. 6, the high-pressure air is controlled by the air valve 24 to urge the piston element 30 to move toward the second segment 21B of the moving tube 21 and to hit the air valve 24, such that the drive unit 20 is actuated to move to the intake head 11 and to force the one buffer 50 and another buffer 50A to compress, and the movable air tube 60 moves in the first guiding orifice 1141 and the second guiding orifice 221, Thereby, the one buffer 50 and another buffer 50A provide flexible buffering effect, and a movement travel of the movable air tube 60 interferes the buffering effect to absorb shock and to reduce a reaction force to user's hands, thus pushing the piston element 30 forwards and backwards.

Accordingly, the pneumatic tool of the present invention has advantages as follows:

1. The piston element 30 of the pneumatic tool moves to the second segment 21B of the moving tube 21 to strike the air valve 24, the piston element 30 actuates the drive unit 20 to move toward the intake head 11 so that the one buffer 50 and another buffer 50A are pressed by the drive unit 20, and the movable air tube 60 moves in the first guiding orifice 1141 and the second guiding orifice 221 so as to produce the buffering effect, wherein the movement travel of the movable air tube 60 interfaces the buffering effect, such that a vibration of the pneumatic tool reduces to protect the user's wrist and to operate the pneumatic tool easily.

2. The piston element 30 of the pneumatic tool moves to the second segment 21B of the moving tube 21 to strike the air valve 24, the piston element 30 actuates the drive unit 20 to move toward the intake head 11 so that the one buffer 50 is pressed by the drive unit 20, and the air outlet segment 62 of the movable air tube 60 contacts with the air valve 24, the air inlet segment 61 contacts with the intake head 11 so as to limit the compression of the one buffer 50 and another buffer 50A, thus protecting the one buffer 50 and another buffer 50A and prolonging a service life of the one buffer 50 and another buffer 50A.

While various embodiments in accordance with the present invention have been shown and described, it is clear to those skilled in the art that further embodiments may be made without departing from the scope of the present invention.

What is claimed is:

1. A pneumatic tool having a movable air tube comprising:

a body including an intake head and a limiting sleeve, the intake head having a switch arranged on an outer wall of the intake head, an air conduit defined in the intake head, and a connection portion formed on an end of the intake head, wherein the connection portion has a first guide element connected on an edge thereof, and the first guide element has a first guiding orifice, a first end of the limiting sleeve is connected with the connection portion of the intake head, and the limiting sleeve has a shoulder formed therein;

a drive unit including a moving tube which has a first segment and a second segment, and the moving tube being slidably received in the limiting sleeve of the body, wherein the moving tube has a protrusion formed on an outer wall thereof and stopped by the shoulder of the limiting sleeve so that the moving tube does not slide forward in the limiting sleeve, the second segment of the moving tube has a second guide element arranged therein, the second guide element has a second guiding orifice defined thereon, the moving tube has a coupling orifice defined on a center of the first segment thereof, the moving tube has a cavity communicating with the coupling orifice, wherein an air valve is defined between the cavity and the second guide element;

a piston element slidably accommodated in the cavity of the drive unit;

at least one buffer being flexible and being received in the limiting sleeve, wherein one of the at least one buffer is defined between the first guide element and the second guide element, and the one buffer includes a first through hole defined on a center thereof; and a movable air tube located on an axis with the air conduit and the piston element, wherein the movable air tube is inserted into the first through hole of the one buffer and a second through hole of another buffer, the movable air tube includes an air inlet segment and an air outlet segment, wherein the air inlet segment is slidably inserted into the first guiding orifice of the first guide element, the air outlet segment is slidably inserted into the second guiding orifice of the second guide element so that the movable air tube slides along the axis forwards and backwards in a non-hand control manner, an outer wall of the air outlet segment of the movable air tube has at least one O-ring engaged thereon so that the at least one O-ring abuts against an inner wall of the second guiding orifice, when the air outlet segment of the movable air tube contacts with the air valve, a first distance is defined among the at least one O-ring and the second guiding orifice adjacent to the intake head, and a second distance is defined between the air inlet segment and the first guiding orifice adjacent to the intake head, wherein the first distance is more than the second distance.

2. The pneumatic tool as claimed in claim 1, wherein the first guide element has a positioning ring and a bushing, wherein the positioning ring has a fitting orifice defined on a center thereof, and the bushing is fitted with the fitting orifice, wherein the bushing has the first guiding orifice defined thereon.

3. The pneumatic tool as claimed in claim 2, wherein the connection portion of the intake head has a groove defined on an edge thereof, and an end of the bushing is inserted into the groove of the connection portion.

4. The pneumatic tool as claimed in claim 1, wherein the moving tube has a fixing trench formed adjacent to the first segment of the moving tube, wherein the fixing trench has a cutout communicating with the coupling orifice and accommodating two defining blocks, and the fixing trench is connected with a restraining loop so as to fix the two defining blocks.

5. The pneumatic tool as claimed in claim 1, wherein the moving tube accommodates a cylinder, and the cylinder has a cavity defined therein.

6. The pneumatic tool as claimed in claim 1, wherein one of the at least one buffer is flexible hemispherical.

7. The pneumatic tool as claimed in claim 1, wherein one of the at least one buffer is a spring.

8. The pneumatic tool as claimed in claim 1, wherein the body includes a shockproof sleeve, the shockproof sleeve is coupled with an end of the limiting sleeve away from the intake head, and the moving tube is slidably received in the limiting sleeve and the shockproof sleeve of the body.

9. The pneumatic tool as claimed in claim 1 further comprising a tool head inserted into the coupling orifice of the moving tube.

* * * * *